US007552953B2

(12) United States Patent
Schmoll et al.

(10) Patent No.: US 7,552,953 B2
(45) Date of Patent: Jun. 30, 2009

(54) DOOR ARRESTER

(75) Inventors: Thomas Schmoll, Wuppertal (DE); Günter Plasberg, Remscheid (DE); Peter Hoffmann, Overath (DE); Gundolf Heinrichs, Remscheid (DE); Ralf Duning, Solingen (DE)

(73) Assignee: Edscha AG, Remscheid (DE)

( * ) Notice: Subject to any disclaimer, the term of this patent is extended or adjusted under 35 U.S.C. 154(b) by 0 days.

(21) Appl. No.: 10/450,798

(22) PCT Filed: Dec. 14, 2001

(86) PCT No.: PCT/DE01/04720

§ 371 (c)(1),
(2), (4) Date: Oct. 10, 2003

(87) PCT Pub. No.: WO02/48489

PCT Pub. Date: Jun. 20, 2002

(65) Prior Publication Data

US 2004/0049882 A1 Mar. 18, 2004

(30) Foreign Application Priority Data

Dec. 14, 2000 (DE) ..... 100 62 277

(51) Int. Cl.
*E05C 17/18* (2006.01)

(52) U.S. Cl. ..... 292/267; 292/278

(58) Field of Classification Search ..... 292/262, 292/265, 267; 16/85, 86, 86 B, 86 C
See application file for complete search history.

(56) References Cited

U.S. PATENT DOCUMENTS 2,266,977 A * 12/1941 Lynch ..... 359/880
2,506,508 A * 5/1950 Kmita ..... 292/288
4,302,045 A * 11/1981 McAdams, Sr. ..... 296/224
4,380,848 A * 4/1983 Guionie et al. ..... 16/85
4,779,927 A * 10/1988 Trutter et al. ..... 297/378.13
5,074,010 A * 12/1991 Gignac et al. ..... 16/334
5,183,302 A * 2/1993 Pelachyk et al. ..... 292/336.3
5,474,344 A * 12/1995 Lee ..... 292/262
6,446,305 B1 * 9/2002 Kneeland ..... 16/82

FOREIGN PATENT DOCUMENTS

| | | |
|---|---|---|
| DE | 574 787 | 3/1933 |
| DE | 1 459 176 | 1/1969 |
| DE | GM 74 35 037 U1 | 2/1975 |

(Continued)

OTHER PUBLICATIONS

English version of International Search Report of WO 02/48489, 6 pages.

*Primary Examiner*—Gary Estremsky
(74) *Attorney, Agent, or Firm*—Davidson, Davidson & Kappel

(57) ABSTRACT

A door arrester for a door of a motor vehicle includes a holder housing including a passage opening for a retaining bar, the holder housing including a first supporting housing part. The first supporting housing part includes injection-molded plastic and a fastening portion for fixing the holder housing onto a part of the motor vehicle. A swinging element and a spring element are provided. The swinging element is pivotable relative to the passage opening toward the retaining bar. The spring element acts upon the swinging element. The first housing part includes a bearing for receiving the swinging element.

39 Claims, 12 Drawing Sheets

FOREIGN PATENT DOCUMENTS

| | | | |
|---|---|---|---|
| DE | 27 31 731 | | 1/1979 |
| DE | 29 44 766 | A1 | 5/1981 |
| DE | G85 09 374.2 | | 7/1985 |
| DE | G 88 00 883.5 | | 4/1988 |
| DE | 41 23 775 | A1 | 1/1993 |
| DE | 44 23 819 | A1 | 1/1996 |
| DE | 94 17 883 | U1 | 4/1996 |
| DE | 40 09 844 | C2 | 6/1997 |
| DE | 196 32 630 | | 2/1998 |
| DE | 298 14 710 | U1 | 2/1999 |
| DE | 44 34 028 | C2 | 3/1999 |
| DE | 198 22 098 | | 11/1999 |
| EP | 0 418 783 | B1 | 9/1993 |
| EP | 0 445 417 | B1 | 5/1994 |
| EP | 0 643 185 | B1 | 1/1997 |
| EP | 0 643 184 | B1 | 11/1997 |
| EP | 0 807 737 | B1 | 5/2001 |
| EP | 0 824 176 | B1 | 6/2003 |
| FR | 2 666 616 | | 9/1990 |
| FR | 2 763 092 | | 5/1997 |
| GB | 2 313 153 | | 11/1997 |
| WO | WO 98/50655 | | 11/1998 |

* cited by examiner

DOOR ARRESTER

The invention relates generally to door arresters, and in particular to a door arrester for motor vehicle doors, comprising a holder housing with a passage opening for a retaining bar, a swinging element which can be pivoted relative to the passage opening in the direction of the narrow side of the retaining bar, and a spring element for acting upon the swinging element.

BACKGROUND

DE 41 23 775 A1 describes a door arrester, in which a door-retaining rod, which is provided with latching markings, is fastened pivotably with its one end to one of the door assembly parts comprising the door and door pillar and can be passed with its other end into a metal holder housing which can be fixed to the corresponding, other door assembly part. In this case, an abutment roll is arranged rotatably in the holder housing on one side of the retaining bar, said abutment roll being in contact with a surface of the retaining bar that is formed without latching markings, and on the other side a swinging element, which is designed as a cage, is mounted on a metallic stud which passes through the holder housing parallel to the abutment roll. The cage has a loading roll which comes into contact with the door-retaining bar and, by means of prestressing a torsion spring designed as a coiled spring, loads the cage. The torsion spring is mounted with its two coiled sections on this stud, the ends of the torsion spring being supported against the holder housing and a loading arm, which connects the two coil sections, acting upon the cage. The known door arrester has a series of deficiencies, in particular, the outlay on installation and the multiplicity of parts are responsible for high manufacturing costs. The geometry of the holder housing is complex, since a multiplicity of parts have to be provided on it, which means that the manufacturing of the corresponding sheet-metal blanks involves correspondingly high costs. The insertion and fixing of the studs forming pivot axes of the cage and the loading roll and the abutment roll requires the provision, which is complex in terms of manufacturing, of holes and elongated slots in the sheet-metal blank and problems to do with tolerances mean that these result in undesirable fluctuations in the retaining forces of the door arresters. The bearing of the torsion spring on the stud requires the two parts to be greased in order to avoid squeaking noises, the action of the grease rapidly declining over prolonged use or if a vehicle heats up due to solar irradiation. Furthermore, the rollers, when their ability to roll diminishes, produce annoying squeaking noises which are undesirable and which at the same time result in increased wear to the roller and retaining bar, since the parts are designed for rolling along each other and not for sliding. In addition, the squeaking noises penetrate continuously to the outside. The actuating resistance of the door arrester changes over its service life, as a result of which an arresting performance which is initially found to be pleasant is gradually found to be annoying. The prestress of the torsion springs means that the parts have to be installed in a sequence in which first of all the door-retaining bar is inserted through a corresponding opening in the holder housing and then the stud is passed through the torsion spring and the cage, which means that the resultant installation unit can be difficult to handle when installing it in a motor vehicle. The known door arrester is heavy and contributes to increasing the overall weight of the vehicle. Finally, because of its unattractive external appearance and the components which are accessible from the outside and because of its sensitivity to corrosion, the known door arrester is fitted only on the inside of a door assembly part, which means that it is difficult to gain access to and the outlay on installation is considerable.

DE 196 32 630 A1 describes a door arrester which functions in accordance with the same functioning principle as that which has been described above. The door arrester has a retaining bar which is guided through an opening of a receiving part which consists of sheet metal. Arranged on the receiving part is a bearing shaft on which a pivoting part is arranged pivotably, said pivoting part being shifted in the direction of the door-retaining bar by the load of a spring or its spring fork, a plastic bearing roller, which sits on a metal bearing bolt, thereby being pressed against the door-retaining bar. On the opposite side, on which the recesses of the door-retaining bar are also arranged, a bearing roller, which is likewise manufactured from plastic, is arranged on a metal bearing bolt, which is mounted on the receiving part, and engages in the latching recesses. In addition to the receiving part, which also has the drill holes for fixing it to a door strut, a plastic covering is provided which likewise has a passage opening for the door-retaining bar and which is pulled onto the receiving part, a bearing shaft which is beared in the receiving part also passing through the covering. All essential parts of the door arrester are mounted on the receiving part as supporting part, and the receiving part is also fixed to the vehicle bodywork, so that the plastic covering merely additionally acts as a trim panel, but not as a functional or supporting part of the door arrester. All in all, the production and installation of the known door arrester are complex and expensive.

DE 44 34 028 C2 shows a further door arrester of this type of construction, in which a swinging element in the manner of a cage is arranged in a metallic housing, is mounted pivotably on a first shank arranged on the housing and in which a roll is mounted on the swinging element, said roll being pressed against the narrow side of a retaining bar. On that narrow side of the retaining bar which faces away from the swinging element and is designed with latching depressions, a further shank supporting a mating roll made of soft plastic is beared on the housing. The production and installation of the known door arrester are complex and expensive. Furthermore, mating rolls of this type which are produced from a soft plastic have a tendency, due to the stress, to form grooves in the roll, and so in heavy doors regularly have to be replaced by metal rolls. In order to obtain sufficient strength, metallically substrates are regularly required for soft plastics of this type thus involving an undesirable multiplicity of parts and materials.

DE 44 23 819 A1 shows a different type of door arrester which guides a ball which is under pressure, in which a door-retaining bar is connected to a ball, which is acted upon by a spring and sits in a guide element, and interacts with a profiled latching rail which has latching recesses, and defines preferred opening positions of the door. The housing on the bodywork is produced from plastic. A swinging element or another rigid element for causing a pivoting movement in the housing is not provided.

DE 94 178 83 U1 or DE 198 22 098 A1 or DE 1 459 176 A1 or DE 40 09 844 C2 also show a different type of construction of door arresters, in which a door-retaining bar can be displaced through a plastic housing, in which the flat surfaces of the door-retaining bar is braked between two sliding bodies which are acted upon by springs, permit an axial adjusting movement and may also have rollers or may consist of hard plastic. A swinging element or another rigid element for causing a pivoting movement in the housing is not provided. The end of the retaining bar generally has a stop which may comprise a buffer or the like.

DE 29 44 766 A1 or FR 2 666 616 A1 describe a door arrester of a simple type of construction, in which elastically prestressed roll bodies cause a braking action along the flat side of the retaining bar, which is provided with bulges, and in which ends of the elastomer bodies protrude out of a housing in the region of the slot recess for the passage of the door-retaining bar and form a compressible stop for the end of the door-retaining bar.

DE 85 093 74 U1 shows an arrester for windows and the like, in which a pair of rolls mounted in plastic holders are pressed against the flat surfaces of a retaining bar causing springs of rubber-elastic profiled components to be prestressed. The holders containing the rolls are pivoted as thickened latching sections of the retaining bar slide past and are pressed against the compressible profiled components. An arrester of this type which brakes a lightweight object owing to the friction of the surfaces which are in contact cannot be used for heavy vehicle doors. Also, the rubber-elastic profiled components do not meet the requirements made of the working life of a motor vehicle door arrester which has to withstand several thousand changes of load without a noticeable change in the retaining moments. In particular, the forces required for shifting the retaining bar in the push and pull directions of the retaining bar differ. Moreover, the production and installation of arresters of this type which are to be composed of a large number of individual parts is time-consuming and costly.

DE 74 350 37 U1 describes a vehicle door arrester, in which a passage opening for a door-retaining bar having raised bulges is provided in a housing, a strut which is arranged on the housing being of flexible and pliable design in such a manner that it is bent out or bent together as it passes the bulge. The strut may be supported by a spring. A first disadvantage of the known door arrester is that the retaining forces differ in the opening direction and in the closing direction. Furthermore, the retaining forces are entirely neutralized in the event of sudden changes of load, which may cause the vehicle door to suddenly swing out. In order to be able to effectively fix the retaining bar, the retaining bar requires bulges on its side which faces the strut. Finally, a pliable strut does not meet the requirements made of the working life of a motor vehicle door arrester which has to withstand several thousand changes of load without a noticeable change in the retaining moments.

DE 27 31 731 A1 describes yet another type of construction of door arresters for motor vehicle doors, in which two plastic sliding components are adjusted at an angle of 45 degrees with respect to a retaining bar by means of rubber bodies designed as springs, a first braking surface of the sliding components rubbing on the flat side of the door-retaining bar, and a second, outer sliding surface bearing against an outwardly bent housing wall of a housing in order, in particular, to obtain an adjustment in the event of the brake wedges becoming worn, bulges being formed in the door-retaining bar and defining preferred arresting positions or resistance on further opening. Although the known door arrester permits uniform retention of the retaining bar in the opening direction as in the closing direction, it also holds true here that the requirements made of the working life of a motor vehicle door arrester, which has to withstand several thousand changes of load without a noticeable change in the retaining moments, are not met by the rubber bodies. Moreover, two housing parts having a plurality of bevels have to be put together in order to accommodate the rubber bodies and the brake wedges.

DE 574 787 C describes a door stop, in which a leather strip is arranged directly, without a housing, on the inside of a door post in order to dampen the impact using a stop cushion which is arranged in the end region of a door-retaining bar.

SUMMARY OF THE INVENTION

It is an object of the invention to provide a door arrester which permits a motor vehicle door to be arrested in an inexpensive and reliable manner.

The invention provides a door arrester for a door of a motor vehicle. The door arrester includes: a holder housing including a passage opening for a retaining bar, the holder housing including at least a first supporting housing part, the at least first supporting housing part including injection-molded plastic and including a fastening portion configured to fix the holder housing onto a part of the motor vehicle; a swinging element pivotable relative to the passage opening toward the retaining bar; and a spring element configured to act upon the swinging element; wherein the first housing part includes a bearing configured to receive the swinging element.

In the door arrester according to the invention, the swinging element, which is arranged in the holder housing, and spring element interact in order to act upon the retaining bar, which passes through the passage opening, and in order to secure preferred latching positions in such a manner that an increased tensile force has to be applied to the door connected to the retaining bar in order to shift said door out of the latching position by stressing the spring element. The door arrester according to the invention can be easily assembled, has a reduced weight and improved sound damping properties. Furthermore, virtually no more noise is produced by it.

Preferred door arresters of the abovementioned type of construction are expediently distinguished by the fact that the spring, as a metal or steel torsion spring, has two coil sections between which is formed a spring fork which transmits the spring force to the swinging element in a manner which is as free from torque as possible, the swinging element furthermore expediently acting upon the narrow side of the retaining bar, i.e. the pivot axis of the swinging element runs transversely to the plane in which the flat surfaces of the retaining bar are situated, the latching recesses preferably being arranged on that narrow side of the retaining bar which faces away from the swinging element.

According to a preferred refinement of the invention, the door arrester comprises a first housing part of the housing, which part is produced from plastic by an injection molding process. The production of the first housing part from plastic advantageously permits a design of the housing in such a manner that the outer contour thereof can be designed independently of the internal fittings, it furthermore being possible for the internal partition of the first housing part to be configured to match those parts of the door arrester which are to be accommodated, which improves the overall esthetic impression of the door arrester in respect of the visual manner of appearance. Thus, for example, the housing parts may be designed in a manner such that they can be stacked. Furthermore, the production of the plastic parts in an injection molding process permits a very substantial encapsulation of the internal fittings of the door arrester which is therefore less sensitive to contamination and moisture attack, which means that it is possible to fit the housing on an outer side of a door assembly part. In particular, a housing can be accommodated in the door assembly part in a hollow which is formed in the outer side thereof and is matched to the external contour of the housing, and it being possible for said housing to be placed in a visually inconspicuous manner particularly if the plastic is coordinated in color with the subsequent finish, if appropriate if finished at the same time as the door assembly part. A further advantage of the design of the housing made substantially from plastic is that the functioning of the holder housing cannot be undesirably impaired by mechanical deformations. It is possible either to insert and encapsulate the spring element in the plastic housing part during the injection molding process or to insert it subsequently into the holder housing.

The first housing part preferably comprises recesses in which the spring element can be circumferentially held, thus enabling, for example, a spring element made from metal or from another spring storage material to be fitted into the recess provided for this in the first housing part or else to be replaced if defective. A design of the recesses in which grooves are provided in the recesses is particularly preferred, said grooves being intended to accommodate adjacent turns of the spring element and to keep said turns at a distance by means of a web protruding between adjacent depressions of the groove. This reduces the risk of the coils of the spring element squeaking when the latter is operated, and at the same time a lubrication which can be difficult to feed in may be omitted. The grooves are preferably already predetermined by the shaping of the housing part and are matched to the diameter of the turns or coils of the spring element, it alternatively being possible to produce the grooves by already inserting the spring element into the mold during the shaping of the first housing part in the injection molding process. However, the spring element is preferably fitted into the first housing part at a later time. It is possible, in the region of the webs which protrude on the inside in the direction of the interior of the recesses, to provide corresponding hollows on the outer side of the first housing part. An imaginary, helical groove is preferably provided for each coil of the spring element, this groove being interrupted outside the regions of the recess in the first housing part by the not entirely circumferential surroundings of the spring element. The advantageous design of the recesses together with the grooves makes it possible in a particularly favorable manner to use a spring element with turns which are already coiled at a distance, said spring element having the advantage of producing a particularly small amount of noise.

The first housing part further preferably has a receptacle for the swinging element, in which said swinging element can be inserted in such a manner that it is pivotably mounted. This makes it possible, for example, to match the swinging element to certain dimensions of the retaining bar, and to arrange differently sized pairings of swinging element and retaining bar in the same housing. In particular, the receptacle for the swinging element is advantageously delimited spatially from the recesses for the spring element, for example the receptacles are arranged in a central section and the two recesses are arranged in outer sections of the housing that laterally extend the central section.

The receptacle for the swinging element circumferentially supports a cylindrical region thereof, the circumference which is engaged around being approximately 180°. In the event of a larger circumference, a portion of the swinging element which is of cylindrical design at least over part of the circumference is advantageously held in a clamping manner, a clamping, resilient securing means being provided by the choice of plastic material.

The first housing part preferably furthermore has protruding ribs which restrict a displacement in the direction of the axis of the cylindrical portion of the swinging element in the manner of stops, the ribs preferably forming, with little play, a stop for the portion which protrudes over the cylindrical circumference of the swinging element.

The housing preferably has a second housing part which is designed as a cover and which closes the first housing part of the housing, for example by screwing or by clipping, in that plane through which the further components of the holder housing are inserted into the first housing part, which further improves the protection against contamination and the ingress of water. In this case, the cover will expediently surround that surface of the door arrester which comes into contact against the door assembly part, with the result that, in the fitted state, the door arrester cannot be opened by removal of the cover. It is possible to physically connect the spring element to the second housing part, so that the prestressing of the swinging element is initiated only by the insertion of the second housing part. In this case, the spring element may be a lug element which projects from the second housing part, is pushed away out of its position by bending, when the cover is made from metal or from plastic, and is thereby prestressed in the opposite direction. In a particularly advantageous manner, play can then be provided for accommodating the second housing part in a corresponding offset of the first housing part, with the result that tightening of a screw connection of the door assembly part increases the prestressing of the swinging element and the action of the spring element can therefore be set in a variable manner. As an alternative, a metal spring may also be integrated or inserted on the second housing part, said spring acting upon that surface of the swinging element which faces away from the retaining bar, for example in the manner of a helical spring. The second housing part is preferably produced in an injection molding process from the same plastic as the first housing part, and, according to a preferred refinement, the two parts can even be formed in a manner such that they are connected to each other, in the manner of a butterfly hinge, and can be produced in a manner such that they can be folded together onto each other. In this case, just one latching device on one of the two housing parts, said device engaging in a latching recess of the other part, is required for locking them together.

According to one preferred variant of an invention, the swinging element may also be produced integrally with the first housing part in an injection molding process, a narrow web defining a butterfly hinge connecting the two parts to each other with a pivot axis being defined.

Spring supports for supporting spring legs of a spring element, which is designed as a torsion spring, are preferably provided on one of the first and second housing parts and, in a particularly inexpensive design, are produced integrally from the material of the particular housing part, for example by means of a plastic projection in the first housing part or by means of a hollow in a cover, which is formed from sheet metal, of the second housing part. As an alternative, the housing part may be provided with threaded drill holes in which the supports are realized by screws and can be shifted axially in the direction of the threaded drill hole, so that the prestressing of the spring element can preferably be set from outside the housing. As an alternative, it is possible to provide the supports in certain sheet-metal sections which are separated from the second housing part, for example, by lines of weakness and are bent by a calking tool or the like from the outside along the line of weakness and can thus be changed in their inclination and therefore the manner in which the torsion spring is acted upon. Finally, provision can be made for the supports to be provided after assembly of the housing by a tool in the form of a punch in the wall of the housing part, with permanent deformation thereof, if appropriate with heat being supplied. Up to this measure, the spring element may remain unstressed, so that, for example, the retaining bar can be pushed in with little force.

The passage opening of the housing is expediently dimensioned in such a manner that the retaining bar can be passed at least with one of their ends through the passage opening, and so the retaining bar and the housing equipped with internal fittings may also be brought into engagement with each other at a later point without the housing and the parts provided in the housing having to be removed. The retaining bar is preferably matched to the retaining forces predetermined by the spring element and the swinging element, and has latching-depression contours which are matched to the circumference of the contour of a corresponding section of the swinging element.

According to a preferred refinement of the invention, the swinging element is designed as an integral plastic part which is preferably produced as a solid material part in an injection molding process. The swinging element can be inserted into the housing irrespective of the housing material which is selected, said swinging element preferably having a cylindrical pin section, the axis of which coincides with the pivot axis of the swinging element. The cylindrical pin section may be circumferentially supported, with the surface structure of the plastic part, in particular if it slides in a correspondingly shaped plastic receptacle of the housing, having favorable surface pairing properties which permit noise-free and lubrication-free, mutual pivoting, as a result of which there is virtually no wear and also no production of noise even if there are a large number of movements in the receptacle. At least one guide portion expediently protrudes radially from the pin section, said guide portion being intended to guide the retaining bar or to enter into contact with a surface of the retaining bar, it being possible for the retaining bar to be designed on its corresponding side either with or without latching depressions. For this purpose, the guide portion preferably has a rounded contour which, even during pivoting about the pin section, permits contact with the retaining bar along a line at least outside latching positions. As an alternative, it is possible to provide in the guide portion a bearing in which a roller is beared rotatably, the roller then, with at least part of its circumferential surface, interacting with the retaining bar. The roller preferably consists of plastic or of metal and has coaxially arranged cylinder portions which are held rotatably in corresponding bearing recesses while the circumference of the roller keeps at a distance from the guide portion of the swinging element. As an alternative, pin portions of the guide portion may conversely engage in corresponding drill holes in the end surface of the roller and support the latter in this manner.

The swinging element is formed from a hard plastic and in a rigid manner, with the result that the swinging element can be rotated about an axis without being bent in the process. As a result, the swinging element can apply the force, which is applied by the torsion spring, to the narrow side of the retaining bar, in which case the coil axis of the torsion spring and the pivot axis of the pivot element preferably coincide. Moreover, the hard plastic of the swinging element prevents a groove from being dug in by the retaining bar sliding past.

A region of the swinging element that faces away from the guide portion is expediently acted upon by the spring element in the direction of the retaining bar, which causes the prestressing of the guide portion and therefore the appropriate latching force for arresting a motor vehicle door to be initiated. According to a preferred refinement of the invention, the spring element, for example a spring fork of a torsion spring that is provided between two coil sections, engages on the guide portion of the swinging element, on its side which faces away from the retaining bar, with the distance from the pivot axis of the swinging element defining the lever arm of the force initiated by the spring element. As an alternative, it is possible to allow the spring element to engage on a further guide portion in the manner of one which protrudes rigidly from the cylinder portion, thus enabling the prestressing of the spring element to be transmitted via the further guide portion and the pin portion to the first guide portion. As an alternative, it is furthermore possible to introduce resilient or prestressing parts into the pin portion of the swinging element and to undertake the prestressing of the swinging element via them. This possibility is favorable, for example, if the parts penetrating into the pin portion interact with a cover part or the like which is to be attached later. It is advantageously possible to design the swinging element integrally with the loading arm of the spring element, for example the spring fork of a torsion spring, for example by placing it into the injection mold, and then inserting them together into the housing of the door arrester.

The spring element is preferably designed as a torsion spring which has at least two coil sections which are circumferentially supported in each case in a recess of the first housing part, a spring fork, which is in engagement with the swinging element, preferably connecting the two coil sections to each other and those ends of the coil sections which face away from the spring fork as legs which are supported against parts of the housing building up the stress of the torsion spring. The circumferential accommodation of the coil sections means that it is not necessary to provide a pin passing through them; however, it is possible nevertheless to insert cores, preferably made from a lightweight material, in one of the coil sections in each case in order to reduce the torsional stressing of the coil sections or, as an alternative, even to arrange a continuous bearing stud in such a manner that the latter also passes through the pin section of the swinging element, in which case the two parts—the bearing stud and swinging element—are arranged rotatably with respect to each other. In this case, a circumferential support of the swinging element is not required in addition. As an alternative, the cores may be provided as extensions of the pin section of the swinging element. However, the coil section is preferably not filled at all. As an alternative to this, it is furthermore possible to provide two stud-type stumps which both engage, if appropriate, at least partially in the pin portion of the swinging element and thereby both axially secure and also pivotably bear said pin section. This design may preferably also take place by driving the stud-type stumps through the housing and, if appropriate, through the coil sections from the outside. The turns of the coil sections are preferably coiled at a distance in order to avoid the production of noise.

A preferred development of the cores involves the latter being circumferentially provided at least in some sections with at least one groove, in which adjacent turns of the groove are restricted by a radially protruding web, the groove being provided preferably in a helical manner on the circumference of the core. The cores expediently have, in the region of the webs, a certain excess length with respect to the inside diameter of a turn of the spring element, with the result that the protruding webs press adjacent turns of the coil sections of the spring element apart. It is then possible to screw the cores into the coil section, in which case the coils of the spring element are forced into the groove and are spaced apart from one another by the protruding webs of the core. This advantageously avoids squeaking noises which arise during operation of the spring element due to adjacent turns of the spring element rubbing together. As an alternative to screwing them in, it is possible to inject the cores into the coil section. It is possible to form the cores as hollow cores for weight-saving reasons.

According to a preferred refinement of the invention, the housing has a control cam which, with regard to the retaining bar, is arranged lying opposite a guide portion of the swinging element, preferably engages in latching depressions provided in the retaining bar and is connected for this purpose fixedly to the housing. The control cam is preferably designed as an integral elevation in the housing, for example by production in the injection molding process, it being possible to form that circumferential region of the control cam which comes into engagement with the retaining bar from a stronger material than the rest of the housing. One particular advantage of the control cam is that the latter can not only be rounded in the direction of movement of the retaining bar, but also may be slightly curved transversely thereto, which means that instead of a line of contact only a point of contact is provided. As an alternative, the control cam may have a central flattened section which is designed as a plate and which represents increased friction and therefore increased braking resistance for the retaining bar. The design of the cam protruding in the direction of the retaining bar advantageously avoids the annoying squeaking noises produced by the metal roller hitherto provided at this point. If the housing is formed from plastic by injection molding, the cam can be formed in a stable manner with little consumption of material and does not require any stabilized edge tabs at which a shank for a rotatable roller otherwise has to be supported.

According to a preferred refinement of the invention, the door arrester has a stop damper which restricts the passage opening for a retaining bar, the stop damper reducing the effect of the impact of a stop formed on the retaining bar in the end region of the passage opening and, in the last displacement section, braking during opening of a motor vehicle door and at the same time damping the noise of the impact. The stop damper may be formed integrally with the housing or else clipped or screwed to the housing in the form of an attached part. The stop damper preferably comprises an encircling plastic framework in which those sections which are generally arranged lying opposite on two sides of the passage opening and are in contact with the stop of the retaining bar are designed for damping purposes. The provision of the encircling framework, which is preferably formed integrally with the housing, but in a metal housing may also be formed by a plastic part which is clipped on and which has been manufactured in the injection molding process, ensures that even in the event of a nonuniform loading, for example if the stop strikes on one side against a side, in particular a side which faces the pivot axis of a motor vehicle door, the load is nevertheless absorbed uniformly and in a lasting manner, even after a multiplicity of braking processes is damped. The design as a part which can be separated from the housing has the advantage that the stop damper can be designed as an inexpensive expendable part which can be exchanged for an identical replacement part when the damping function diminishes.

According to a first preferred refinement of a stop damper, the latter comprises a compressible elastomer body which is produced from an elastomer material provided with an inner restoring force, and can be compressed to damp the impact in order to convert the impact energy into elastic deformation. The impact against an elastomer body, which may, for example, be a strip of polyurethane foam, can be inexpensively fitted into a plastic stop damper by encapsulation without a bonding surface of the elastomer body slipping under solar irradiation. Furthermore, the elastomer body also has an inner deformation which permits a deviation into other regions which are not loaded by the stop of the retaining bar, and thereby permits effective braking.

The at least one elastomer body preferably protrudes over the end region of the passage opening and thus defines a breaking region which protrudes beyond the end region and in which the impact energy is converted into elastic deformation energy of the elastomer body until the region surrounding the elastomer body is reached, which region either defines an end stop or itself in turn can be designed compliantly, in another manner, for example as described below, for conversion into deformation energy. A respective strip of elastomer body is preferably arranged mirror-symmetrically on both sides of the passage opening, so that if a stop of the retaining bar has two wings, each of the wings is braked by an elastomer body.

A further preferred refinement of the stop damper provides a guide element which is injection molded integrally with the housing or with the framework of the stop damper and can be changed in its relative position and design with respect to the housing via a deformable connection or its own deformable design, the stop damper in the initial design being prestressed or relaxed in the direction of a raised position. A respective guide element is expediently arranged mirror-symmetrically on both sides of the passage opening, said guide elements being arranged on a common framework, which may also be formed integrally with the housing, as a result of which the two guide elements can each be assigned to one of the wings of the stop of the retaining bar. It has to be understood that the guide elements themselves may in turn be equipped with an above-described elastomer body.

According to a first preferred development, the guide element is arranged in a cutout of a wall of the passage opening and can be coupled toward a base which is provided there, the guide element being connected to the wall via at least two connections which absorb a primary deformation energy. These connections are preferably plastic webs which are secured by sufficient thickness against tearing off, but at the same time permit a preferred, elastic deformation, as a result of which that stop region of the guide element which is defined between the webs can be shifted in the direction of the base. The connection may also be provided on one side, but in this case it is bent away under the load of the stop and the base in the wall then defines the end stop of the stop of the retaining bar. In contrast, if it is connected on both sides, the guide element is shifted in the direction of movement of the retaining bar, and an indirect stop of the retaining bar against the base occurs, the stop being buffered by the guide element arranged in between. For this purpose, the guide element may be thickened in its striking region in a lens-like manner, the lens being flattened by the lens-like body being pressed against the base by the pressure of the stop of the retaining bar and an elastic change in shape by means of temporary displacement of material taking place, so that the impact-damping action is further assisted by the elastic change in shape of the lens-shaped body and, correspondingly, so too is the energy conversion. It is possible, for this purpose, to provide a lens-like bulge which is directed only toward the base or toward the stop; as an alternative, it is also possible to provide a dome-like form in both directions. It is furthermore possible to provide the lens-shaped body with a cavity which permits the lens-shaped body to be additionally partitioned off when pressurized and, as a result, permits even more deformation. In this case, the lens-shaped body is designed as a bubble. The shaping of the guide element, which is designed as a deformation body, enables a damping characteristic to be defined via the impact path, said characteristic differing in steepness and it being possible for it to be optimized according to the desired production of noise and other properties which are to be damped and according to the weight of the door.

A further preferred development of the stop damper provides a guide element which can be shifted via a resilient connection which can be folded in into a raised position which can be forced back by the impact of the stop of the retaining bar into a lowered position with energy being accumulated, a corresponding conversion of the impact energy taking place to stress the resilient connection and the impact thereby being damped. It is also possible here to combine the guide element with damping means of the above-described type to additionally damp it either on one or both sides of the guide body, for example by designing it as a lens-shaped body or by providing elastomer dampers. Furthermore, it is possible to design the damping element as a framework which can be placed independently onto a housing, restricts the passage opening by at least partially encircling it and therefore brings about effective damping even in a metal housing.

BRIEF DESCRIPTION OF THE DRAWINGS

The invention will be explained in greater detail below based on exemplary embodiments and with reference to the attached drawings.

FIG. 7 shows a partially cut-away illustration of a second exemplary embodiment of a door arrester according to the invention.

DETAILED DESCRIPTION

Figure 1:
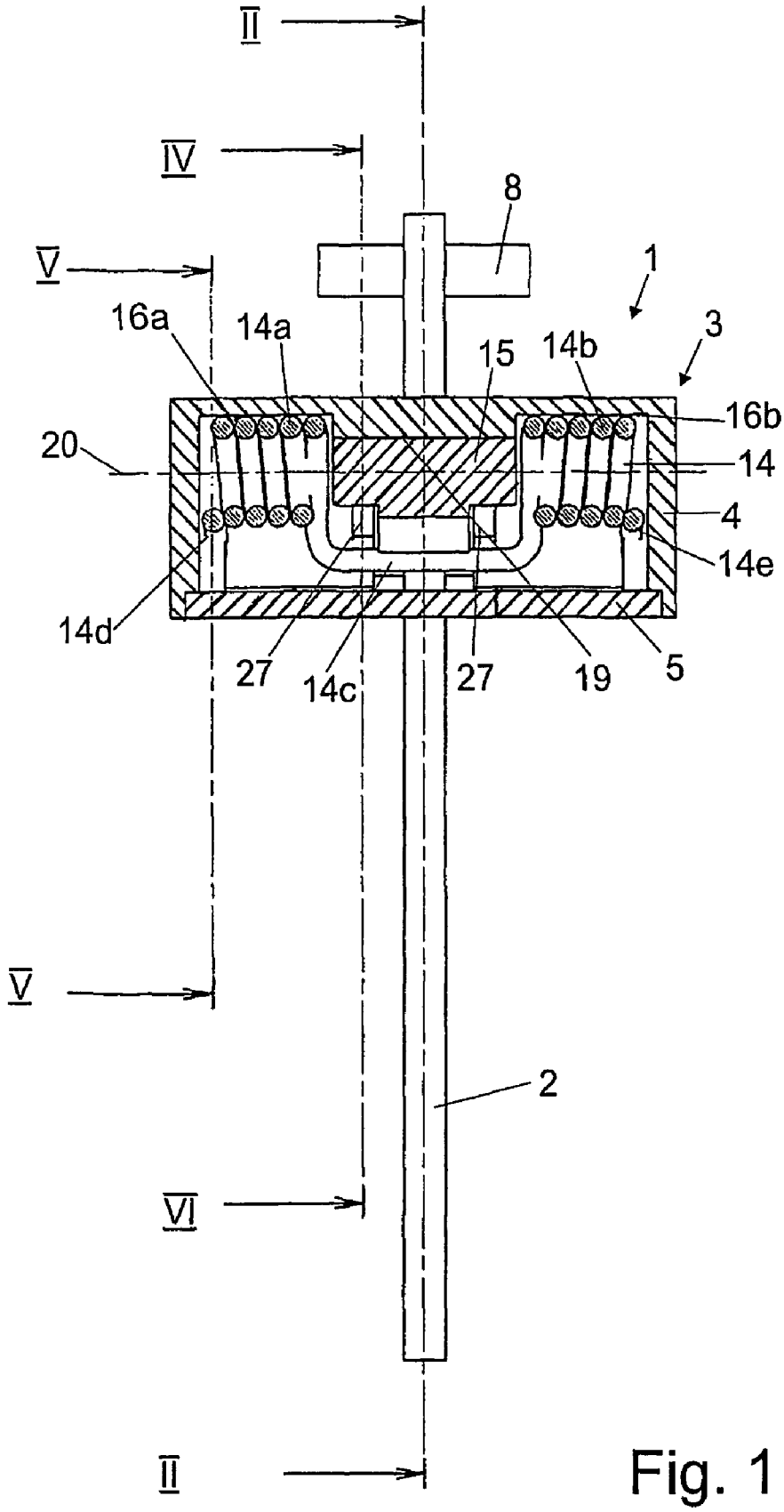
FIG. 1 shows a partially cut-away illustration of a first exemplary embodiment of a door arrester according to the invention.

The door arrester illustrated in FIGS. 1 to 6, which is referred to overall by reference number 1, comprises a retaining bar 2 and a housing 3, which is composed of a first housing part 4 and a second housing part 5 which both consist of plastic and are clipped to each other.

The retaining bar 2 has, at its one end, a bearing eyelet 6 for fastening it pivotably to a door assembly part, for example to a door of a motor vehicle, and is guided through an opening 7 of the housing 3, a stop 8, which passes through the other end of the retaining bar 2, preventing the retaining bar 2 from tearing out of the housing 3 and restricting the pivoting path of the door. The retaining bar 2 is designed, for example, as a metallic blank of flat material which can be produced by stamping or forging, it being possible for this purpose also for a plurality of blanks of flat material, for example two, to be placed on one another and to be connected to one another in the region of the bearing eyelet 6 and the stop 8 in such a manner that they act as one part. As an alternative, at least the surface of the retaining bar may consist of a plastic. The retaining bar 2 has a slightly curved shape, with two latching depressions 10 and 11 being provided in the inwardly pointing edge 9 of the retaining bar 2 while a latching depression 13, which corresponds to the closed position of the door, is formed in the outwardly pointing edge 12 of the retaining bar 2.

Arranged in the first housing part 4 of the housing 3 is a spring element which is designed as a coiled or torsion spring 14 with two coil sections 14*a*, 14*b* and the spring fork 14*c* of which, which connects the coil sections 14*a*, 14*b* and acts as a loading arm, is supported against a portion of a swinging element 15, which section has a corresponding groove, while the two spring legs 14*d*, 14*e*, which adjoin the coil sections 14*a*, 14*b*, are supported in the housing 3, as will be explained in greater detail further below.

The two coil sections 14*a*, 14*b* are accommodated in correspondingly designed recesses 16*a*, 16*b* of the first housing part 4. The circumferential mounting of the torsion spring 14 with its coil sections 14*a*, 14*b* in the recesses 16*a*, 16*b* means that it is not necessary to pass a bearing element through the coil sections 14*a*, 14*b*.

Figure 9:
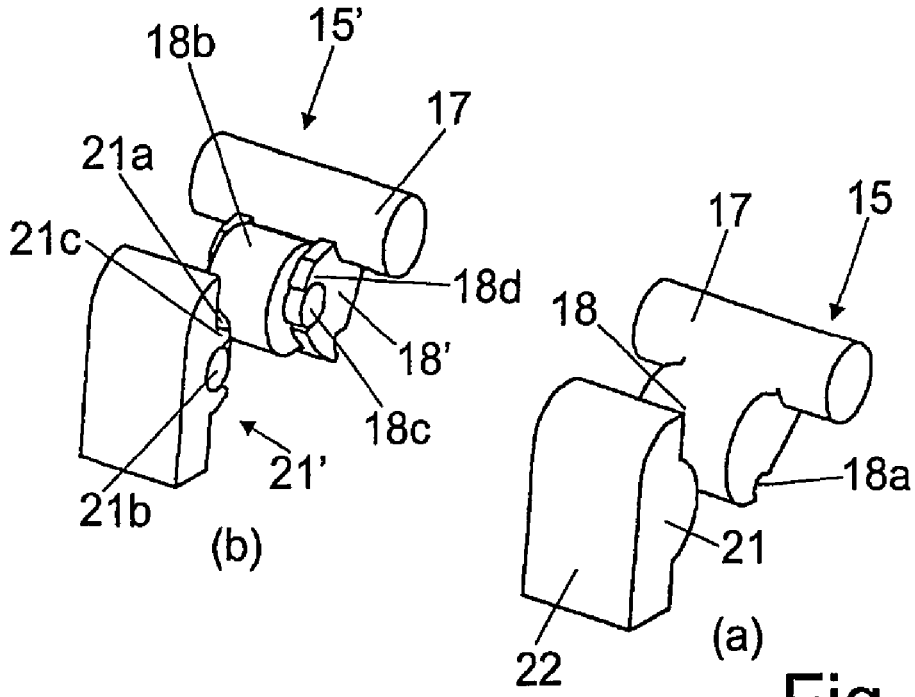
FIG. 9 shows details of those parts of the door arrester from FIG. 1 and from FIG. 7 which act upon the retaining bar.

FIG. 9(*a*) shows the swinging element 15 in a perspective view. The swinging element 15 is produced integrally from a plastic in an injection molding process, the swinging element 15 comprising a pin portion 17 which has essentially a circular-cylindrical cross section and which is provided, in the manner of an upper part of a T-section, with a guide portion 18 which rigidly adjoins the pin portion 17, forms the upstroke of the T-section and the one contour of which, facing the retaining bar 2, is of rounded design and the other contour of which facing away from the retaining bar 2 is designed with a groove 18*a* for the mounting of the spring fork 14*c*. The pin section 17 of the swinging element 15 is guided pivotably in a receptacle 19 of the first housing part 4, which receptacle is matched to the cylinder diameter of the pin portion 17 and is likewise circular-cylindrical in cross section, as can be seen in particular in FIGS. 2 and 3, the axis of the pin portion 17 in the installed state being coaxially aligned with the axis of the coiled sections 14*a* and 14*b*, which axis is referred to in FIG.

1 by 20, in order to pass on to the swinging element 15 a torque, which is as favorable as possible, from the action on the spring fork 14*c*.

Figure 2:
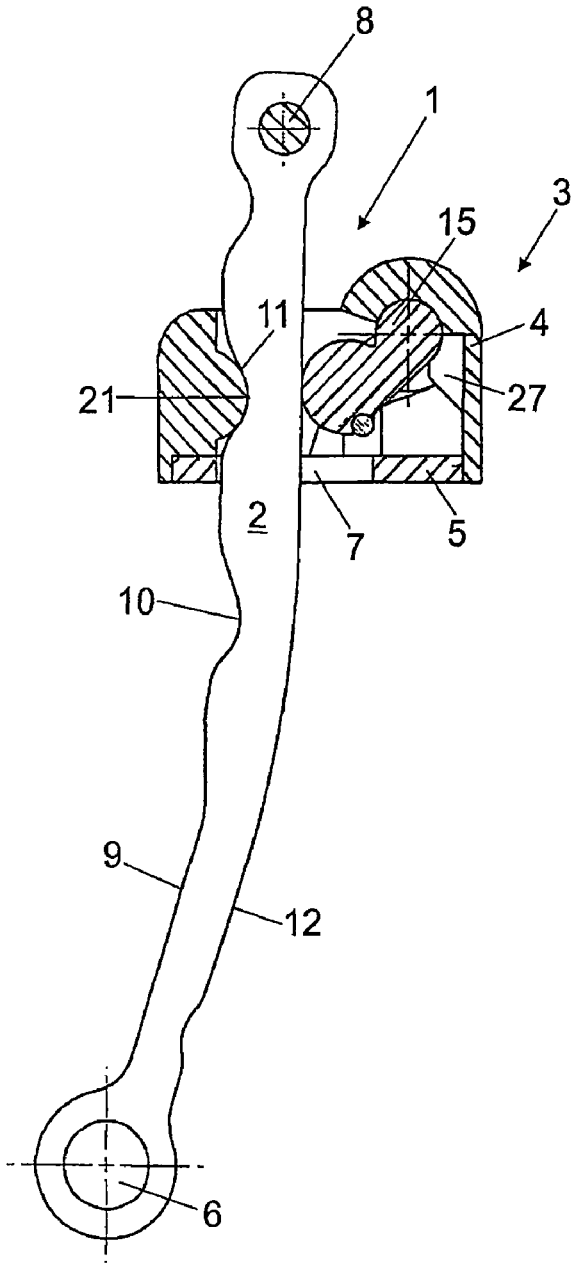
FIG. 2 shows a longitudinal section through the door arrester along the line II-II from FIG. 1 in a latching position.
Figure 3:
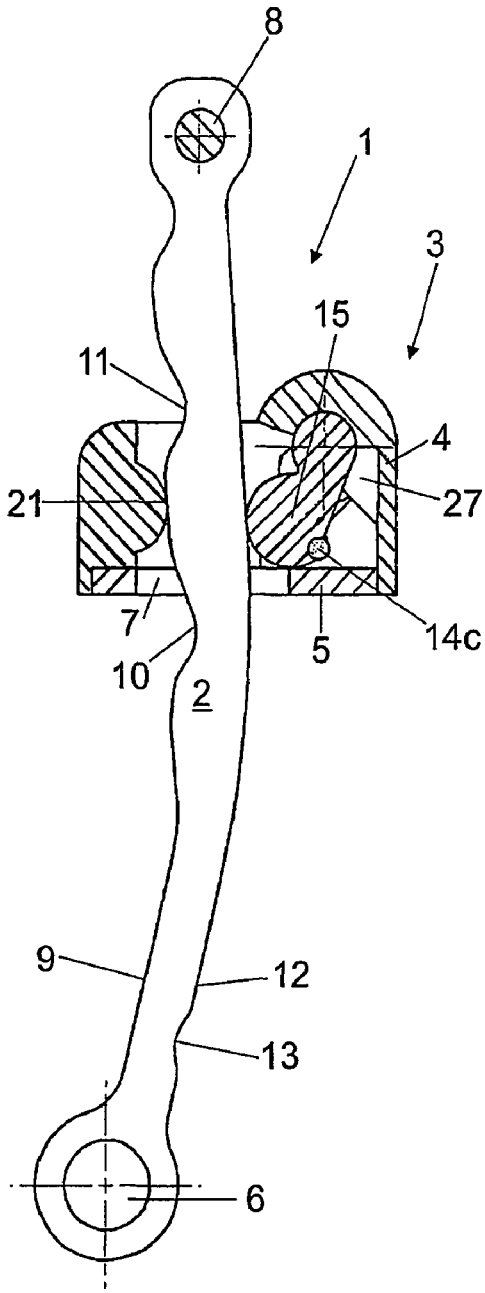
FIG. 3 shows a longitudinal section through the door arrester from FIG. 2 outside a latching position.
Figure 5:
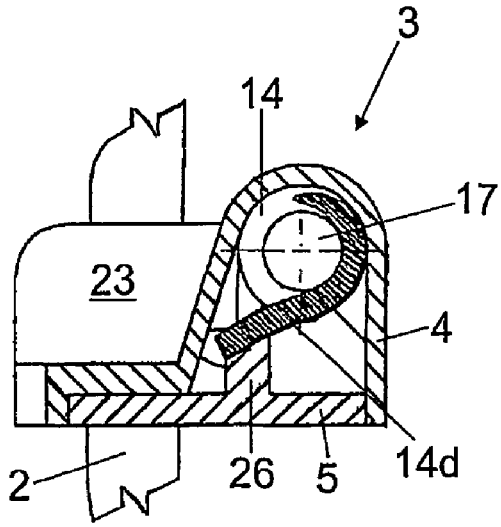
FIG. 5 shows a longitudinal section through the door arrester along the line V-V from FIG. 1.
Figure 4:
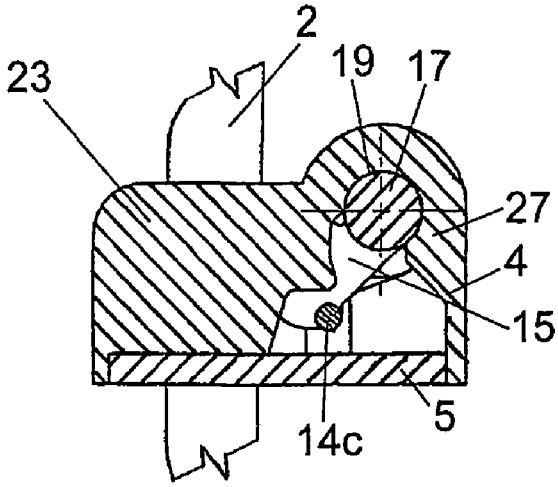
FIG. 4 shows a longitudinal section through the door arrester along the line IV-IV from FIG. 1.

With reference to FIGS. 1, 2 and 4, it can be seen that ribs 27 are formed in the first housing part 4, said ribs circumferentially extending the receptacle 19 for the pin portion 17 of the swinging element 15 and protruding in such a manner that they surround the guide portion 18 of the swinging element 15 on both sides and therefore ensure that it does not migrate laterally.

The first housing part 4 furthermore comprises a control cam 21 which is arranged in a manner such that it cannot be changed in its position relative to the opening 7 of the housing 3 and interacts with that edge 9 of the retaining bar 2 which has the latching depressions 10, 11. Since the position of the control cam 21 cannot be displaced, a shifting of the retaining bar 2 in the direction of that wall of the first housing part 3 which shows the control cam 21, with the swinging element, which is loaded by the spring fork 14*c*, being prestressed, takes place as the depressions 10 or 11 slide past the control cam 21. The control cam 21 is arranged on a protruding wall section 22 of the first housing part 4 and at the same time restricts the opening 7. Furthermore, side walls 23 are provided on both sides of the control cam 21, said side walls likewise restricting the opening 7 and being produced from plastic integrally with the first housing part 4. In the present case, the end sides of the side wall 23 restrict the possible shifting path for the retaining bar 2 and for the stop 8. Outside the lateral walls 23, the first housing part 4 has two flat regions 24 which are pierced by holes 25 for fastening to a door assembly part, the flat regions being produced integrally together with the walls 22, 23, the control cam 21 and the remaining parts of the first housing part 4, as a result of which great strength and torsional rigidity of the first housing part 4 is provided.

The second housing part 5 is embedded in a springing-back step of the first housing part 4 and is designed as a cover which closes at least that region of the first housing part 4 in which the torsion spring 14 and the swinging element 15 are arranged, and, moreover, in the exemplary embodiment is also provided below the flat regions 25 of the first housing part 4. It has to be understood that the drill holes for the holes 25 have then also to be provided in an aligned manner in the second housing part 5. It furthermore has to be understood that the region of the opening 7, through which the retaining bar 2 passes, remains recessed in the second housing part 5. In the exemplary embodiment according to FIG. 5, a spring support 26 is formed integrally with the second housing part 5, which is likewise produced integrally from a plastic material, and in each case one of the legs 14*d*, 14*e* of the torsion spring 14 is supported on said spring support. It is possible to connect the second housing part 5 to the first housing part 4 during installation of the door arrester 1, for example by means of the holes 25, as a result of which prestressing is applied to the spring 14 and therefore to the swinging element 15 via the spring supports 26; in the present case, the second housing part 5 has latching needles which engage together with corresponding openings in the first housing part 4, preferably in an aligned manner, and clip the first housing part 4 and the second housing part 5 to each other. As an alternative, it is possible to provide other joining methods, for example bonding or the like.

Figure 6:
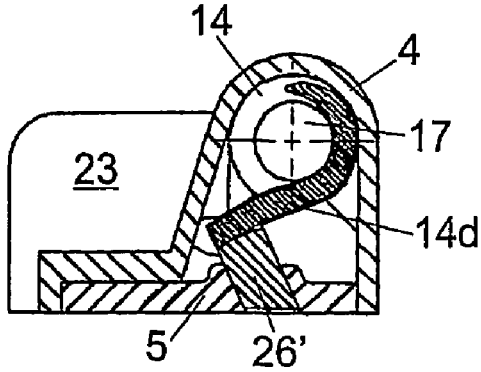
FIG. 6 shows an alternative design of a spring support from the design from FIG. 5.
Figure 8:
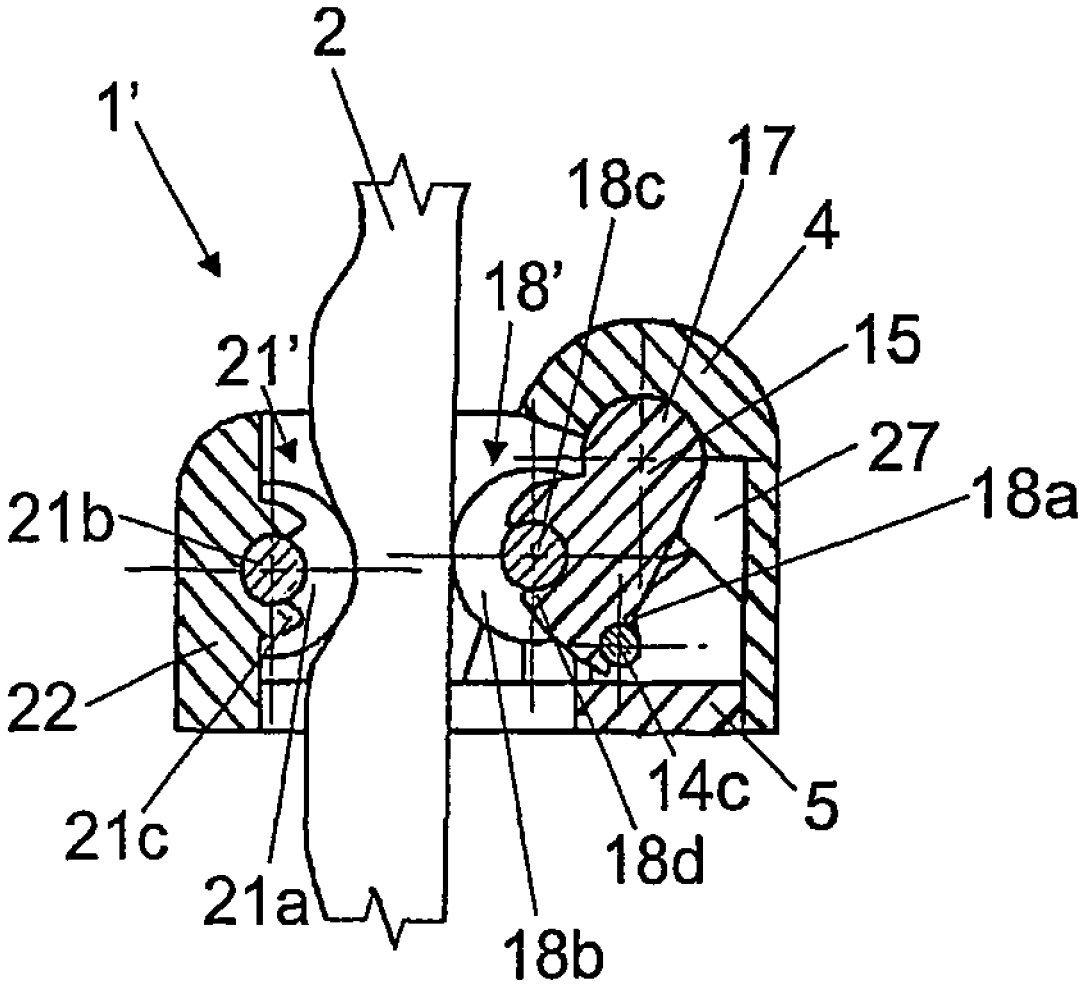
FIG. 8 shows a longitudinal section through the door arrester along the line VIII-VIII from FIG. 7.

In FIG. 6, an alternative design of the spring support is described, in which an adjustable spring-support element 26' is provided in the manner of a screw in a corresponding thread of the second housing part 5 which can be changed in its position via a hexagon socket or a screwdriver in such a manner that the prestress acting on the torsion spring 14 can be set appropriately.

FIG. 7 shows a further exemplary embodiment of a door arrester 1' according to the invention, in which parts which are the same or are functionally comparable as in the previous exemplary embodiment are referred to by the same reference numbers unless stated otherwise in this regard.

The construction of the door arrester 1' according to FIG. 7 corresponds essentially to that of the door arrester 1 according to FIG. 1, but instead of the control cam 21 and guide section 18 designed in the form of sliders, the design according to FIG. 9(*b*) is provided, according to which the cam 21' is formed by a roll 21*a* which is held rotatably via laterally protruding pins 21*b* in two corresponding bearings 21*c* of the first plastic part 4, as a result of which the roll 21*a* can be rotated in the one or other direction with little rotational resistance as the holding bar 2 slides past. The roll 21*a* may consist either of metal or of plastic, in which case the receptacle in the mounting 21*c* of the first housing part 4 does not require any lubrication.

The guide portion 18' of the swinging element 15 also has a groove 18*a* for the spring fork 14*c* of the torsion spring 14. On the side facing away from the spring fork 14*c*, a roller 18*b* is held pivotably via coaxially protruding roller pins 18*c* in corresponding mountings 18*d* of the guide portion 18' of the swinging element 15. The retaining bar 2 is guided here along the roller 18*b* which is rotated by the shifting of the retaining bar 2. The roller 18*b* may be formed from plastic or from metal, the roll 21*a* and the roller 18*b* preferably consisting of the same material and also having identical dimensions, so that the same part can be used as desired on this side and the other side of the retaining bar 2. This advantageously reduces the stock keeping and the susceptibility to installation errors. It has to be understood that the designs 21, 21' of the cam and 18, 18' of the guide portion can also be combined in a crossed-over manner with the designs according to FIGS. 9(*a*) and (*b*), i.e. that, for example, the guide portion 18 can be combined with the control cam 21' or the control cam 21 can be combined with the guide portion 18'.

Figure 10:
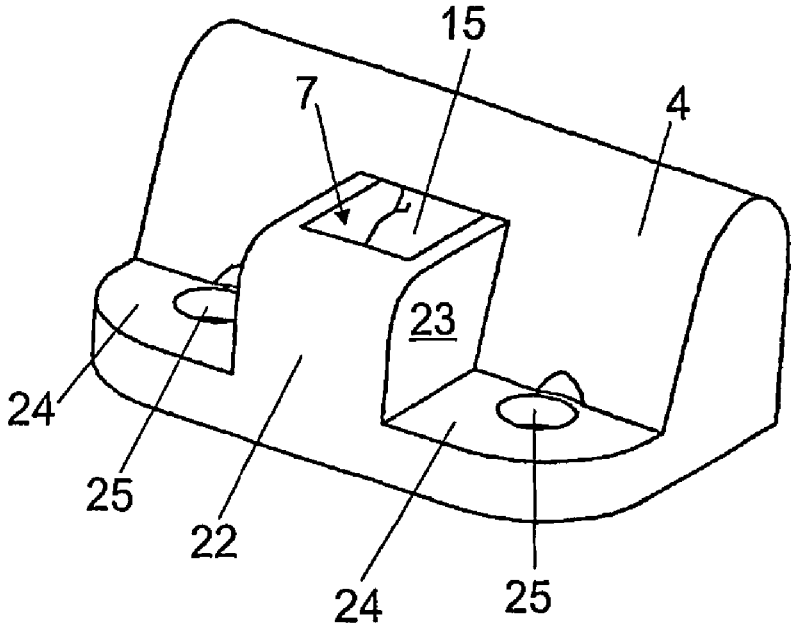
FIG. 10 shows a perspective view of a housing part which can be used for the door arresters from FIG. 1 or FIG. 7.

FIG. 10 shows perspectively the housing 3 for the door arrester according to FIG. 1 or FIG. 7.

Figure 11:
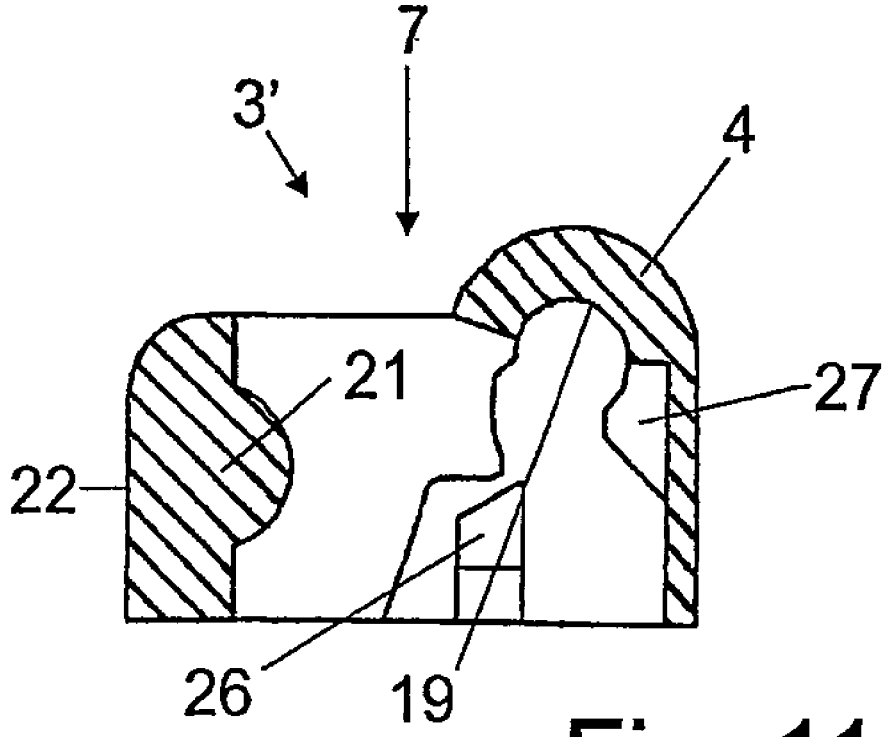
FIG. 11 shows a longitudinal section through a housing part comparable to FIG. 8 without a cover.

FIG. 11 shows an alternative design of a housing 3' which consists exclusively of a first housing part 4 and is designed without a cover or second housing part. For better illustration, the torsion spring 14 and the swinging element 15 are not shown. In this case, the spring support 26 is formed integrally with the first housing part 4 by being connected, for example in the form of a laterally protruding web, to the wall of the first housing part 4. It can be seen that that lower region of the first housing part 4 which faces the door assembly part essentially remains open, so that the torsion spring 14 and swinging element 15 (which are not illustrated here) can be inserted, it being possible for parts of the cover 5 from FIG. 1 to be replaced by plastic walls produced integrally with the first housing part 4. In this connection, it may be necessary to provide the injection molding process with removable cores in a number of steps.

Figure 12:
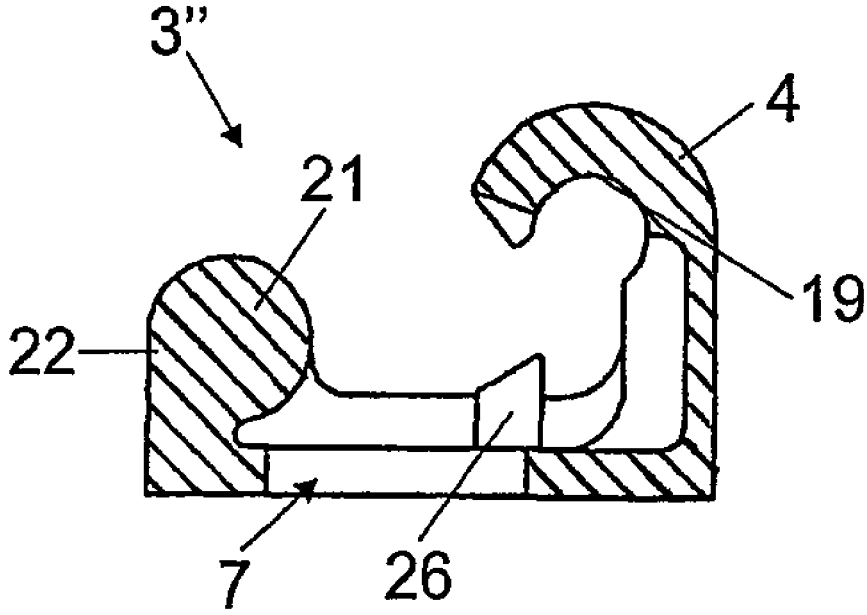
FIG. 12 shows a longitudinal section through an alternative design of the housings from FIGS. 1 to 10.
Figure 14:
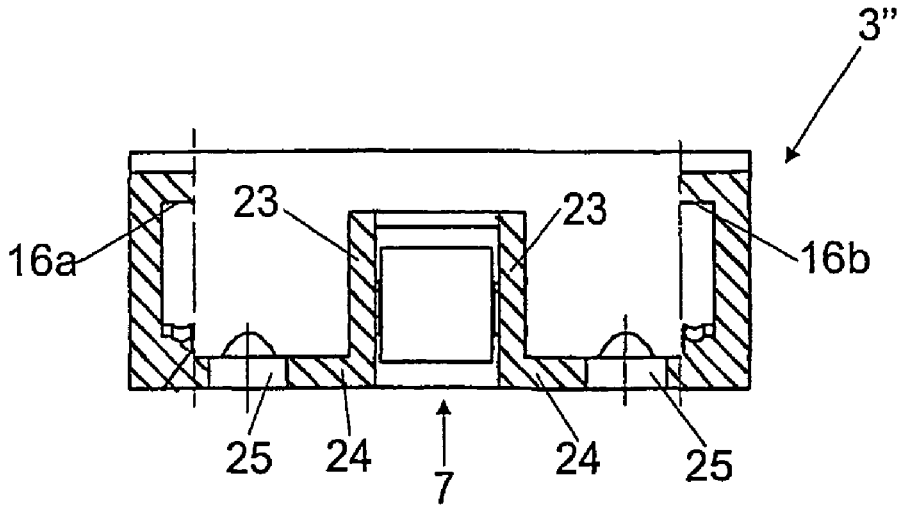
FIG. 14 shows a section along the line XIV-XIV through the housing from FIG. 13.
Figure 13:
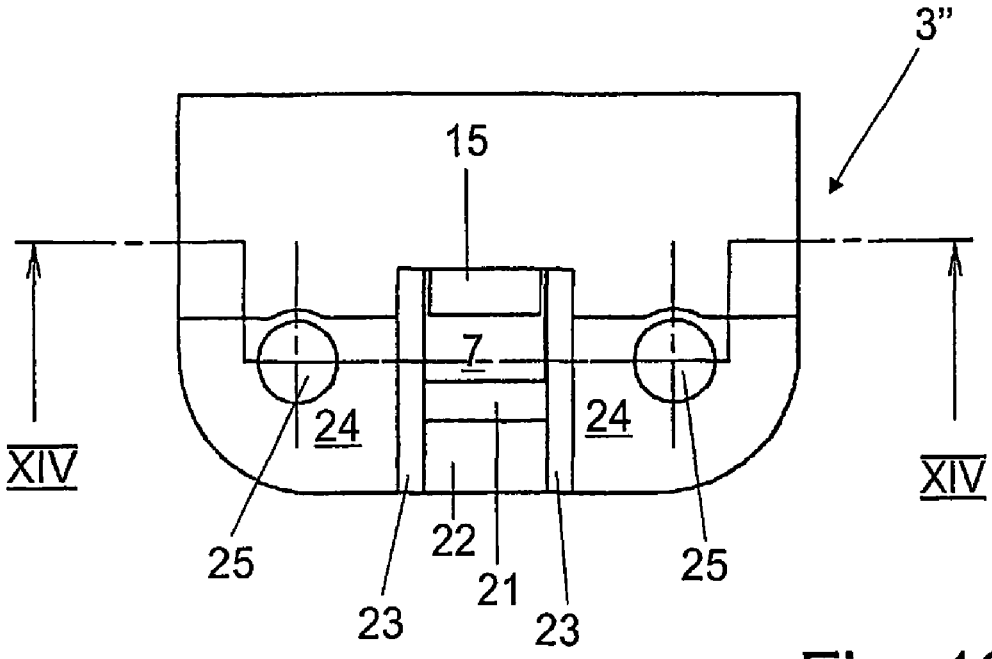
FIG. 13 shows a plan view of the housing from FIG. 12.

FIGS. 12 to 14 show a further alternative exemplary embodiment for a housing 3", in which the single housing part 4 in this case is designed essentially as a cover part which can be placed onto the door assembly part while the region spanning the control cam 21 remains recessed and therefore has an opening facing away from the door assembly part for the insertion of the spring element 14 and swinging element 15.

Figure 15:
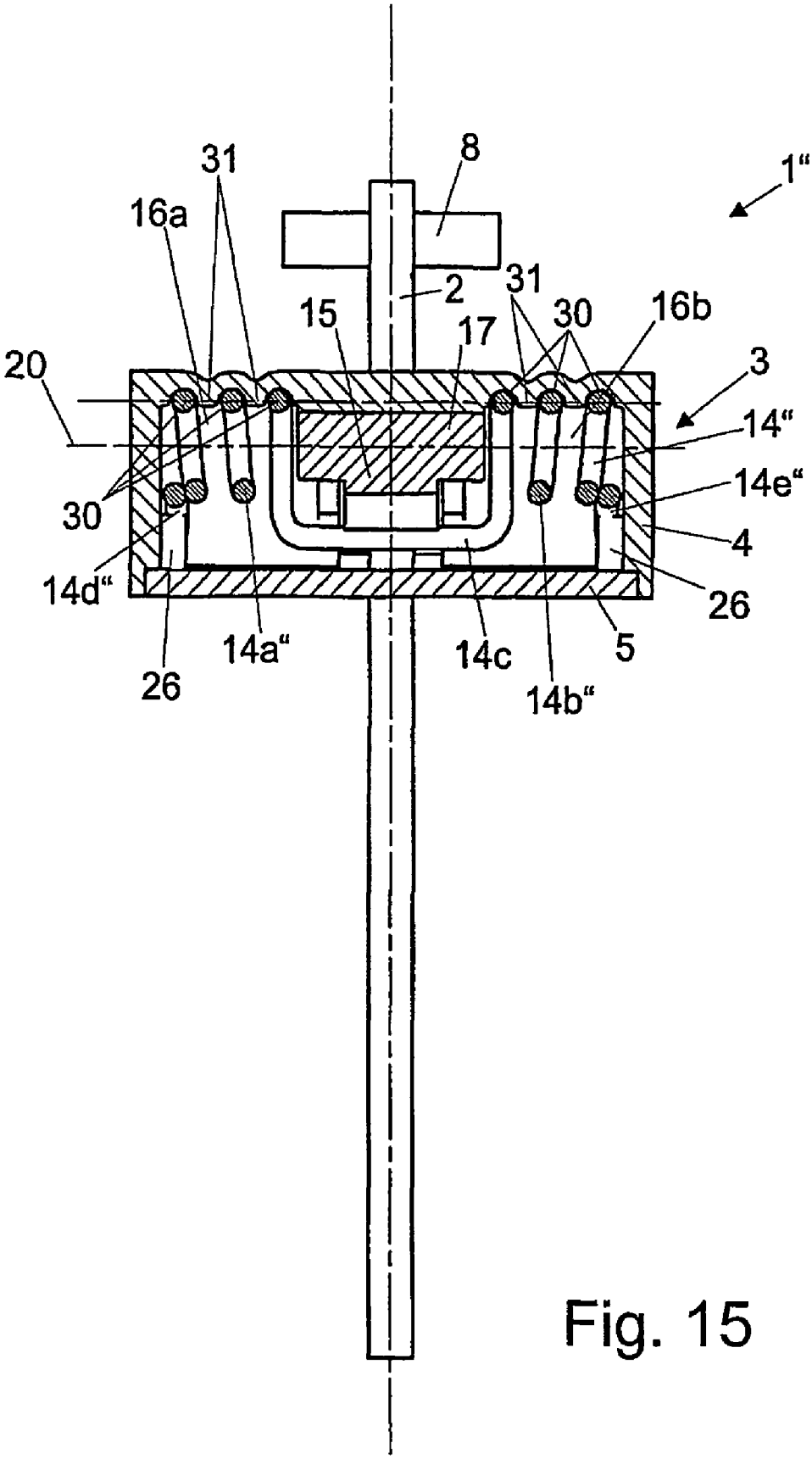
FIG. 15 shows a partially cut-away illustration of a third exemplary embodiment of a door arrester according to the invention.
Figure 16:
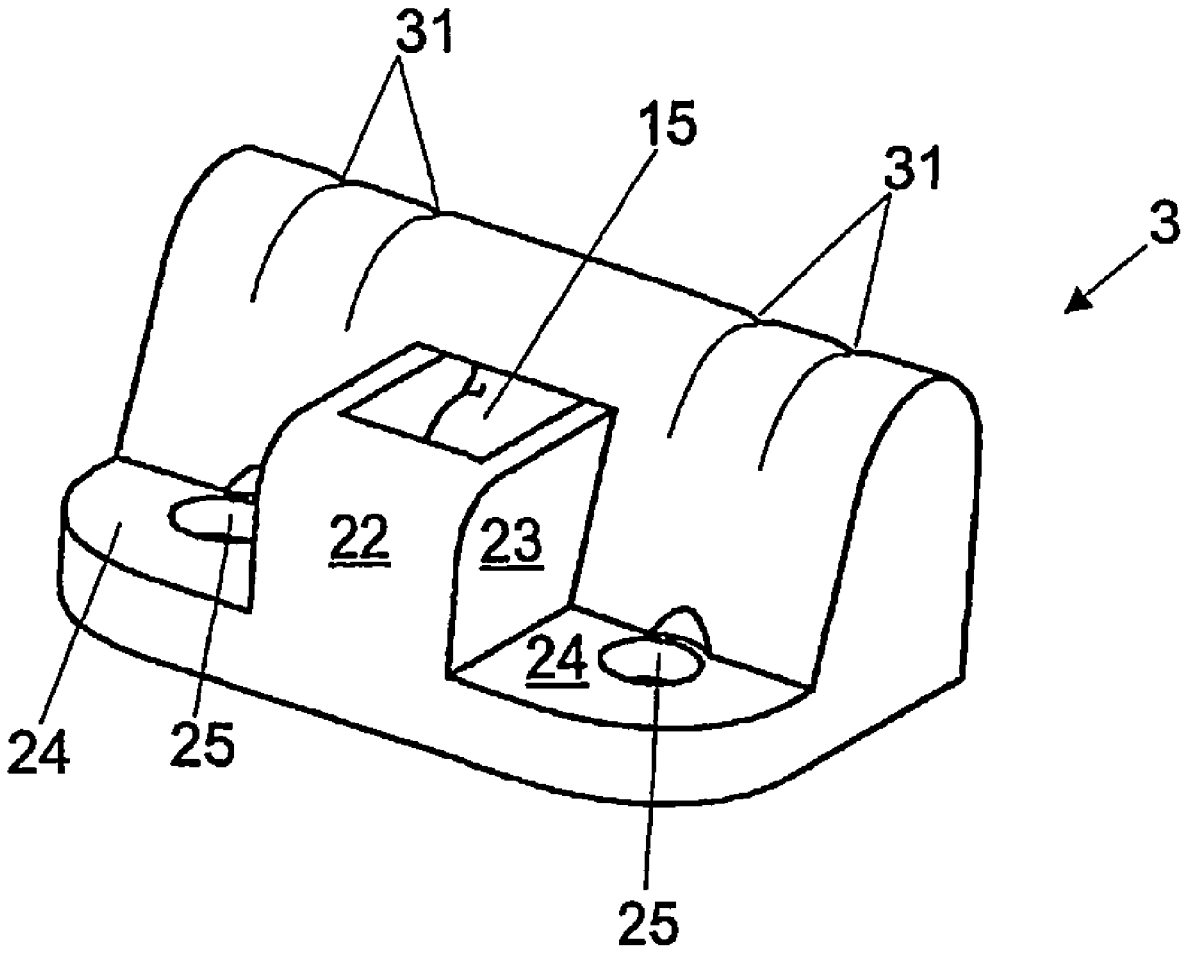
FIG. 16 shows a perspective view of a housing part of the door arrester from FIG. 15.

FIGS. 15 and 16 illustrate a further preferred exemplary embodiment of a door arrester 1" according to the invention, the construction of which corresponds essentially to that of FIGS. 1 to 5 and in which the same reference numbers therefore refer to parts which are the same or are functionally comparable. Reference is therefore made below essentially to the differences.

The door arrester 1" likewise has a housing 3 with a first housing part 4 and a second housing part 5, which is designed as a cover, and furthermore a swinging element 15 which can be designed in one of the ways described above. A torsion spring 14" is held by its coil sections 14*a*", 14*b*" in corresponding recesses 16*a*, 16*b* of the first housing part 4, the spring fork 14*c* of which torsion spring is supported against the swinging element 15, and its ends 14*d*", 14*e*" of the coil sections 14*a*", 14*b*" that face away from the spring fork 14*c* are supported on corresponding spring supports 26. The coil sections 14*a*", 14*b*" of the torsion spring 14" are coiled at a distance in such a manner that the turns arranged adjacent to one another are at a distance from one another which corresponds approximately to the diameter of the spring wire or to the width of a turn. This ensures that no squeaking noises arise during tensioning and relaxing of the torsion spring 14" due to adjacent turns rubbing against one another. For this purpose, it is advantageously possible to coil the coil sections 14*a*", 14*b*" at a distance, as a result of which the torsion spring 14 is designed to be correspondingly low in noise even during insertion.

Moreover, in the present case, the first housing part 4 has, in the region of the recesses 16*a*, 16*b*, a groove-like, helically designed profiling which, in the concave region in which the coil sections 14*a*", 14*b*" are circumferentially engaged around, defines grooves 30 for the coils, which grooves are matched to the diameter of the coils and, in the regions in which gaps are provided between adjacent turns, have a protruding web 31 which, in relation to the base of the groove 30, is somewhat higher than half of the thickness of the wire of the torsion spring and thus keeps adjacent coils at a distance. This ensures in a particularly reliable manner that even if the door arrester 1" is subjected to particularly unfavorable stresses, noise is not produced by the turns rubbing against one another. If cores are inserted into the cavities of the coil sections 14*a*", 14*b*", provision may likewise be made to design them with an embedded groove for accommodating the coils and with a web running in a raised manner in between in order to separate adjacent coils.

It can be seen in FIGS. 15 and 16 that, in the present case, the coil sections 14*a*", 14*b*" are coiled three times, and accordingly two web regions 31 protrude in the direction of the interior of the first housing part 4. In the region of the webs 31, as can be seen in particular in FIG. 16, the outer side of the first housing part 4, which consists of plastic and is produced in an injection molding process, is drawn in resulting in a particularly characteristic and aesthetically attractive design of the housing.

Figure 19:
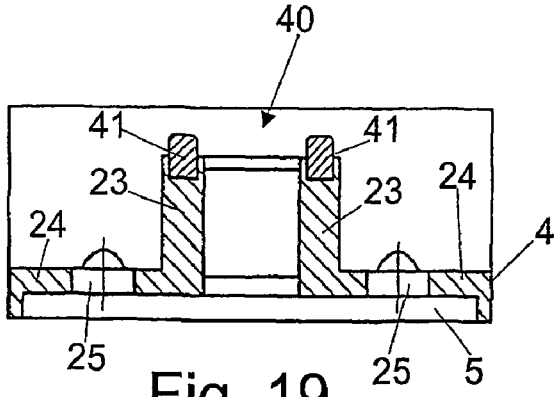
FIG. 19 shows a section through the housing of the door arrester from FIGS. 17 and 18.
Figure 18:
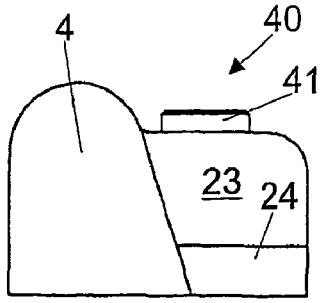
FIG. 18 shows a side view of the door arrester from FIG. 17.
Figure 17:
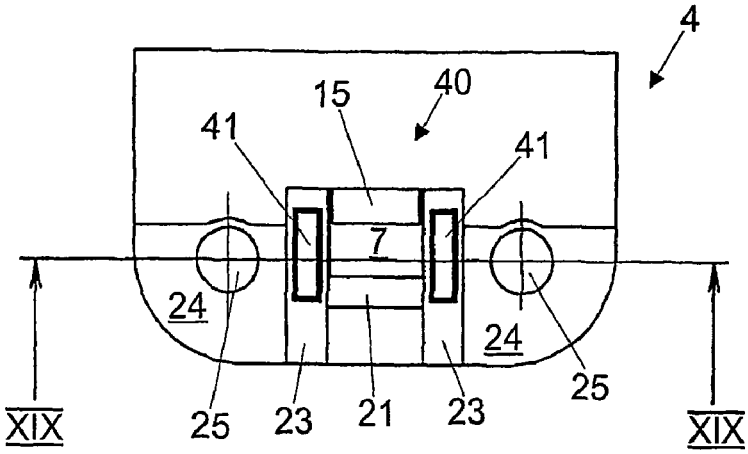
FIG. 17 shows a plan view of a fourth exemplary embodiment of a door arrester according to the invention.

With reference to FIGS. 17 to 19, a further preferred exemplary embodiment of a door arrester is described, the door arrester comprising, in the region of the passage opening 7 of the housing 3 for a retaining bar (not illustrated), a stop damper which is referred to in its entirety by 40 and which secures that end side of the passage opening 7 which faces the stop 8 of the retaining part 2 against the production of noise during impact of the stop 8 and against an unintentional rebound.

In the present case, the stop damper 40 is formed integrally with the first housing part 4 in an injection molding process; however, it is possible to form the stop damper 40 in a separate framework part which is connected to a corresponding housing of a door arrester, alternatively also consisting of metal or else designed as a conventional base plate, in a suitable manner, for example by bonding, soldering, welding, clipping, screwing, joining or the like.

In the exemplary embodiment according to FIGS. 17 to 19, the stop damper 40 comprises two strips of elastomer body 41 which are designed in a strip-shaped manner and are arranged parallel to each other in a mirror-inverted manner with respect to the bisecting lines of the passage opening 7 and have already been injected during the production of the first housing part 4 and are therefore inserted fixedly in the material of the first housing part 4, said strips of elastomer body protruding with approximately half of their height (cf. FIG. 19) over the end side of the passage opening 7 and therefore forming an elastically deformable resistance for the stop 8 of the retaining bar 2 prior to the impact against the end side of the passage opening 7. When the two wings of the stop 8 of the retaining bar 2 impact against the elastomer bodies 41, the latter are deformed under the load of the stop into the regions protruding over the end side, the configuration of the elastomer body, for example, from polyurethane foam or the like, causing a reversible displacement or deviation of the strips of elastomer body 41, this action absorbing considerable deformation energy on account of the tough nature of the material and therefore correspondingly damping the kinetic energy of an impact and its noise.

The fixed securing of the elastomer strips 41 in the side walls 23 of the passage opening 7 at the same time ensures that migration of the elastomer strips, and hence the disabling of the stop damping, is avoided under solar irradiation or under a different temperature load. It can be seen in particular in FIG. 17 that the elastomer strips 41, which are rectangular in basic outline, are surrounded on all four sides in the region of their lower half by the plastic material of the walls 23 and, moreover, have beveled corners or edges in the region of their protruding half, so that the mechanical stressing in these regions is reduced from the outset.

Figure 22:
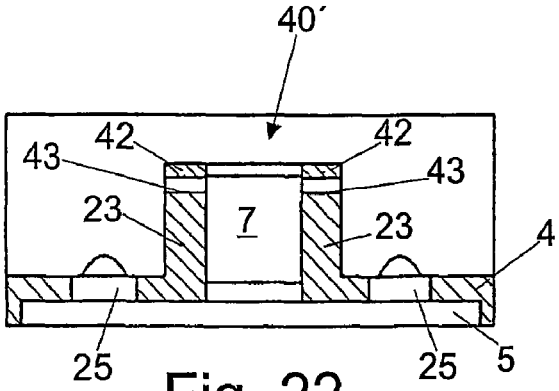
FIG. 22 shows a section through the housing of the door arrester from FIGS. 20 and 21.
Figure 21:
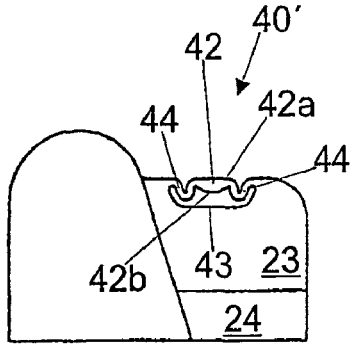
FIG. 21 shows a side view of the door arrester from FIG. 20.
Figure 20:
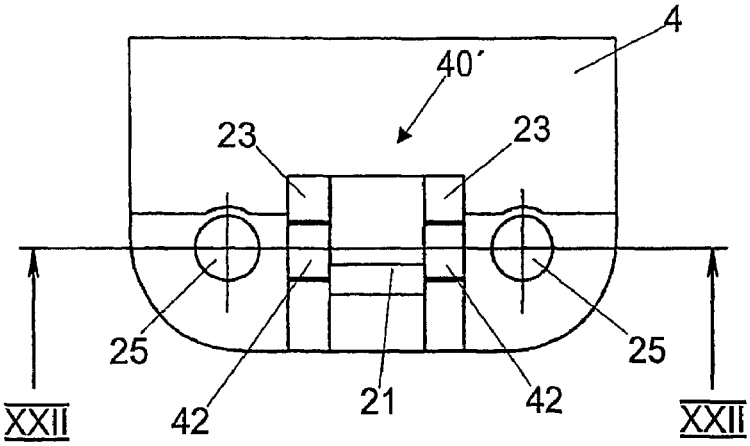
FIG. 20 shows a plan view of a fifth exemplary embodiment of a door arrester according to the invention.

A further exemplary embodiment of a door arrester with a stop damper 40' designed in a different manner in comparison with FIGS. 17 to 19 is revealed in FIGS. 20 to 22, in which the same reference numbers as in the previous exemplary embodiments refer to the same or functionally comparable parts.

The first housing part 4 of the housing 3 is also formed here from plastic in an injection molding process, a guide element 42 being formed in the lateral walls 23, which laterally restrict by means of their stop 8 the passage opening 7 for a retaining bar 2, said guide element having a flat upper side 42*a* in the impact region of the stop 8 approximately flush with the end side of the passage opening 7. The lower side 42*b* of the guide element 42 that faces away from the upper side 42*a* is rounded spherically downward and points to a base 43 which is formed in the wall 23. The guide element 42 is connected on both sides to the wall 23 via pliable plastic webs 44 which allow the guide element 42*a* displacement path in order to allow the lower side 42*b* of the guide element 42 to strike against the base 43. A first stop damping takes place by means of the deformation of the webs 44 which permit the guide element 42 to be lowered. After the lower side 42*b* of the guide element 42 has come into contact with the base 43, the guide element 42 can also undergo an elastic deformation under the action of the impact of the stop 8 in such a manner that instead of a line of contact between the base 43 and lower side 42*b*, the guide element 42 is pressed flat, with the result that extensive contact and transmission of force comes about. If the upper side 42*a* of the guide element is likewise of spherical design so that the guide element has a lens-like form, an elastic deformation can also take place on the upper side 42*a*, said deformation converting further impact energy into deformation energy and damping the impact.

The impact damper 40' has a respective guide element 42 on two opposite sides, each of the two guide elements 42 being assigned in each case to a wing of the stop 8 of the retaining bar 2. It is possible to design the wall 23 to be higher, so that the dimensions of the end stop can be established taking into consideration the displacement path of the guide element 42 in the direction of the base 43, as in the case of a wall 23 of rigid design.

Figure 25:
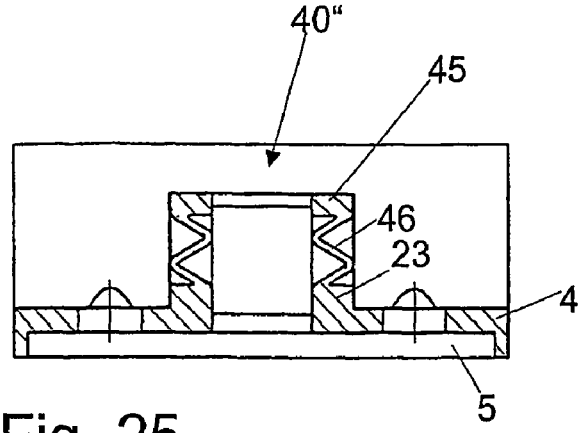
FIG. 25 shows a section through the housing of the door arrester from FIGS. 23 and 24.
Figure 24:
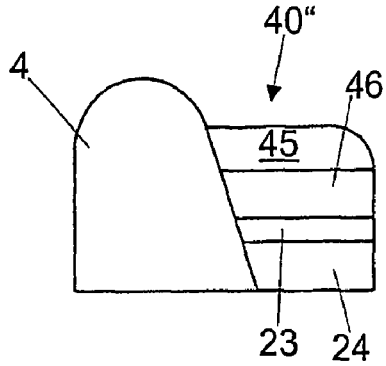
FIG. 24 shows a side view of the door arrester from FIG. 23.
Figure 23:
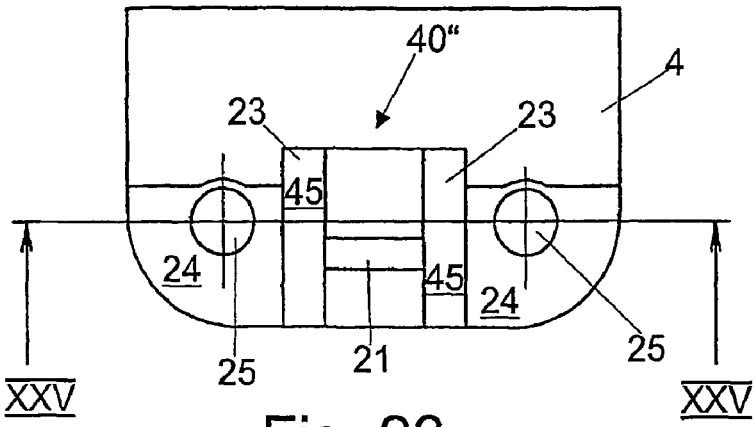
FIG. 23 shows a plan view of a sixth exemplary embodiment of a door arrester according to the invention.

A third exemplary embodiment of a stop damper 40" is illustrated in FIGS. 23 to 25, the same reference numbers as in the preceding exemplary embodiments referring to the same or functionally comparable parts.

The stop damper 40" is likewise formed integrally with the first housing part 4 of the housing 3 in an injection molding process, and has two guide elements which are designed as stop bars 45 and against which the wings of the stop 8 strike. The stop bars 45 are connected to the side walls via two plastic springs 46 which can be folded in twice, are formed from the same plastic as the housing part 4 and the bars 45 and prestress the bars 45 in a raised position.

The two bars 45 are arranged mirror-symmetrically on both sides of the bisecting line of the passage opening 7 and, in the present case, are furthermore connected to each other via a transverse web, as a result of which the system is mechanically coupled to the two springs 46 and the two strips 45 and also a loading on one side has the effect of stressing both springs 46.

Striking against the stop 8 causes the two strips 45 to be prestressed by the springs 46 being folded together in the direction of one edge of the wall 23, with the impact energy being converted by the elastic change in shape.

Three designs of stop dampers 40, 40', 40" have been described above and they each use different mechanisms for damping an impact. It has to be understood that also two or more of the above-described embodiments can advantageously be combined with one another to the effect that they are realized jointly in one stop damper.

Three designs of preferred stop dampers 40, 40', 40" have been described above and have each been produced integrally with a first housing part 4. It has to be understood that the stop dampers which have been described can also be produced separately from the housing on a framework part defining a frame, and can be combined with any desired housings of door arresters.

The abovementioned exemplary embodiments have described various designs of swinging elements 15 and control cams 21. It has to be understood that a particularly preferred design of a door arrester is distinguished in that both the control cam 21 and the swinging element 15 are designed as sliding elements without additional movable parts when in contact with the holding bar, irrespective of the design of the housing.

It has to be understood that the variants with rollers or rolls can equally well be used in the case of the exemplary embodiments according to FIG. 11 or 12 as in FIG. 7.

The invention has been described above with reference to door arresters in which the housings 3 are fixed on the inner side of a door assembly part, in particular a door strut. Owing to the favorable acoustic and optical effects of the door arresters according to the invention, the latter may also be arranged on the outer side of the door assembly part. In this case, the retaining bar 2 is inserted the other way around.

The invention claimed is:

1. A door arrester for a door of a motor vehicle, comprising:

a holder housing including a passage opening for a retaining bar and at least a first housing part made of plastic;

a swinging element including a guide portion;

a torsion spring element configured to act upon the swinging element; and a control cam formed as a single integral piece with the first housing part and protruding towards the passage opening, the control cam being disposed opposite the guide portion;

wherein the guide portion is pivotably urged toward the retaining bar around a pivotable axis and relative to the passage opening by the torsion spring element; and wherein the pivotable axis is arranged at a constant distance from the control cam.

2. The door arrester as recited in claim 1, the holder housing including injection-molded plastic and including a fastening portion configured to fix the holder housing onto a part of the motor vehicle.

3. The door arrester as recited in claim 1, wherein the holder housing includes at least one recess configured to circumferentially hold the torsion spring element.

4. The door arrester as recited in claim 3 wherein the at least one recess includes grooves configured to engage adjacent turns of the spring element and maintain the adjacent turns at a distance from each other.

5. The door arrester as recited in claim 3, wherein the at least one recess includes a first and a second recess and wherein the receptacle is disposed in a central portion of the housing between the first and second recess.

6. The door arrester as recited in claim 1, wherein the holder housing includes a second housing part configured to close a first housing part along at least one plane.

7. The door arrester as recited in claim 6, wherein the first housing part includes a receptacle configured to pivotably receive the swinging element.

8. The door arrester as recited in claim 6, wherein the swinging element is pivotably movable in a swinging plane, and wherein the first housing part includes protruding ribs configured to restrict a displacement of the swinging element normally with respect to said swinging plane.

9. The door arrester as recited in claim 6, wherein the second housing part includes a plastic material and forms a cover capable of being fastened to the first housing part.

10. The door arrester as recited in claim 6, wherein the swinging element and the spring element are removably disposed in the first housing part.

11. The door arrester as recited in claim 1, wherein the holder housing includes supports for supporting spring legs of the torsion spring element.

12. The door arrester as recited in claim 11, wherein the supports are formed from plastic integrally with a corresponding part of the holder housing.

13. The door arrester as recited in claim 11, wherein the supports include elements capable of being adjusted in the housing so as to set a prestress of the torsion spring element.

14. The door arrester as recited in claim 1, wherein a fastening portion of the holder housing includes holes.

15. The door arrester as recited in claim 1, wherein the swinging element is a rigid part pivotably disposed on the holder housing.

16. The door arrester as recited in claim 1, wherein the swinging element includes a cylindrical pin portion, an axis of the pin portion coinciding with a pivot axis of the swinging element.

17. The door arrester as recited in claim 1, wherein the swinging element includes a guide portion having a rounded contour configured to guide the retaining bar.

18. The door arrester as recited in claim 17, wherein the guide portion includes a bearing having a roller rotatably disposed thereon.

19. The door arrester as recited in claim 1, wherein the control cam includes a rounded sliding surface.

20. The door arrester as recited in claim 1, wherein the retaining bar includes a plastic coating disposed at least on a surface configured to contact said control cam.

21. The door as recited in claim 1 further comprising:

a stop damper disposed on the frontal end of the passage opening and configured to interact with a stop member of the retaining bar so as to dampen an impact of the retaining bar on the holder housing;

wherein the stop damper and a housing part circumferentially limiting the passage opening are integrally formed as a single piece.

22. The door arrester as recited in claim 21, wherein the stop damper includes a compressible elastomer body.

23. The door arrester as recited in claim 22, wherein the elastomer body protrudes over the frontal end of the passage opening and is integral with a plastic material of the housing.

24. The door arrester as recited in claim 22, further comprising a second compressible elastomer body, the elastomer body and second elastomer body being mirror-symmetrically disposed relative to each other on respective sides of the passage opening.

25. A door arrester for a door of a motor vehicle, comprising:

a holder housing having a passage opening for a retaining bar;

the holder housing including a fastening portion configured to fix the holder housing onto a part of the motor vehicle;

a swinging element pivotable relative to the passage opening toward a narrow surface of the retaining bar, the swinging element comprising an integral rigid pin portion having an axis, the rigid pin portion being rotatably received in the housing; and a spring element contacting the swinging element to urge the swinging element in one rotational direction around said axis against the narrow surface of the retaining bar;

wherein the spring element includes a torsion spring having coil sections circumferentially supported in a recess of the housing.

26. The door arrester as recited in claim 25, wherein the pin portion is cylindrical and has an axis coinciding with a pivot axis of the swinging element.

27. The door arrester as recited in claim 25, wherein the swinging element includes injection molded plastic.

28. The door arrester as recited in claim 27, wherein the plastic includes a matrix resin including, at least locally, a fiber reinforcement including aramid fibers.

29. The door arrester as recited in claim 25, wherein the swinging element includes a guide portion having a rounded contour configured to guide the retaining bar.

30. The door arrester as recited in claim 29, wherein the guide portion includes a bearing having a roller rotatably disposed thereon.

31. The door arrester as recited in claim 30, wherein the roller includes plastic and has lateral cylinder portions rotatably disposed in corresponding recesses of the bearing.

32. The door arrester as recited in claim 29, the guide portion includes a groove on a side thereof opposite the retaining bar configured to receive a loading arm of the spring element.

33. The door arrester as recited in claim 25, wherein the spring element includes a torsion spring having coil sections circumferentially supported in a recess of the housing.

34. The door arrester as recited in claim 25, wherein the torsion spring includes two coil sections connected with each other by a spring fork, the spring fork being in engagement with a portion of the swinging element distant from an axis of the pin portion.

35. A door arrester for a door of a motor vehicle, comprising:

a holder housing having a passage opening for a retaining bar;

a swinging element pivotable relative to the passage opening toward the retaining bar;

a rigid pin portion pivotably received in the housing; and a spring element configured to act upon the swinging element;

wherein the spring element includes a torsion spring having two coil sections connected with each other by a spring fork, the spring fork being configured to urge the swinging element toward the retaining bar;

wherein the swinging element is fixedly connected to the pin portion to rotate together as a single piece;

wherein the swinging element includes a guide portion having a rounded contour configured to guide the retaining bar; and wherein an axial length of the pin portion exceeds a width of the guide portion, and wherein the pin portion protrudes at both ends thereof over the guide portion.

36. A door arrester for a door of a motor vehicle, comprising:

a holder housing having a passage opening for a retaining bar;

a swinging element pivotable relative to the passage opening toward a narrow surface of the retaining bar, the swinging element comprising an integral rigid pin portion having an axis, the rigid pin portion being rotatably received in the housing; and a spring element contacting the swinging element to urge the swinging element in one rotational direction around said axis against the narrow surface of the retaining bar;

wherein the retaining bar includes a plastic coating at least on a surface configured to contact said swinging element.

37. The door arrester as recited in claim 36, wherein the holder housing includes a control cam disposed, relative to the retaining bar, opposite a guide portion of the swinging element.

38. The door arrester as recited in claim 36, wherein the spring element includes a torsion spring having two coil sections connected with each other by a spring fork, the spring fork being configured to urge the swinging element toward the retaining bar.

39. The door arrester as recited in claim 36, further comprising a stop damper disposed in a frontal region of the passage opening, the stop damper being configured to interact with a stop member of the retaining bar so as to damp an impact of the stop member.

* * * * *

UNITED STATES PATENT AND TRADEMARK OFFICE

CERTIFICATE OF CORRECTION

PATENT NO. : 7,552,953 B2
APPLICATION NO. : 10/450798
DATED : June 30, 2009
INVENTOR(S) : Thomas Schmoll et al.

It is certified that error appears in the above-identified patent and that said Letters Patent is hereby corrected as shown below:

In the drawings, after sheet 3 of 12, insert missing Figure 7.

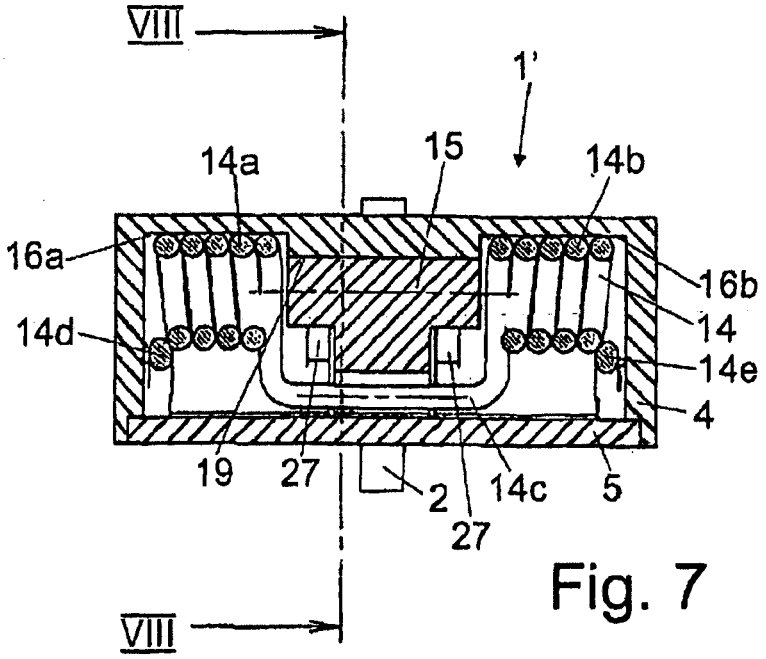

Fig. 7

Signed and Sealed this

Twenty-eighth Day of September, 2010

David J. Kappos

David J. Kappos
*Director of the United States Patent and Trademark Office*